US010842222B2

(12) United States Patent
Zahabian

(10) Patent No.: US 10,842,222 B2
(45) Date of Patent: Nov. 24, 2020

(54) COLLAPSIBLE SHOE HEEL

(71) Applicant: Zeba Designs LLC, Paramus, NJ (US)

(72) Inventor: Michael Zahabian, Paramus, NJ (US)

(73) Assignee: ZEBA DESIGNS LLC, Paramus, NJ (US)

( * ) Notice: Subject to any disclaimer, the term of this patent is extended or adjusted under 35 U.S.C. 154(b) by 143 days.

(21) Appl. No.: 15/196,296

(22) Filed: Jun. 29, 2016

(65) Prior Publication Data

US 2016/0374427 A1 Dec. 29, 2016

Related U.S. Application Data

(60) Provisional application No. 62/186,148, filed on Jun. 29, 2015.

(51) Int. Cl.
*A43B 11/00* (2006.01)
*A43B 3/24* (2006.01)

(52) U.S. Cl.
CPC ..... *A43B 11/00* (2013.01); *A43B 3/24* (2013.01)

(58) Field of Classification Search
CPC ..... A43B 13/60; A43B 13/181; A43B 3/128; A43C 1/00
USPC ..... 36/102
See application file for complete search history.

(56) References Cited

U.S. PATENT DOCUMENTS

| | | | | |
|---|---|---|---|---|
| 1,686,175 | A | 8/1924 | Read | |
| 2,198,228 | A | 4/1940 | Pinaud et al. | |
| 2,920,402 | A * | 1/1960 | Minera | A43B 3/102 36/58.5 |
| 3,174,234 | A | 3/1965 | Weitzner | |
| 3,431,658 | A | 3/1969 | Finn | |
| 4,596,080 | A * | 6/1986 | Benoit | A43B 5/048 36/118.9 |
| 6,298,583 | B1 | 10/2001 | Allen | |
| 7,168,190 | B1 | 1/2007 | Gillespie | |
| 7,331,122 | B2 | 2/2008 | Janusewski et al. | |
| 7,578,075 | B1 | 8/2009 | Kemp | |
| 7,793,438 | B1 | 9/2010 | Busse et al. | |
| 8,020,320 | B2 | 9/2011 | Gillespie | |
| 9,675,132 | B2 * | 6/2017 | Marshall | A43B 11/00 |

(Continued)

FOREIGN PATENT DOCUMENTS

| | | |
|---|---|---|
| CN | 2493059 Y | 5/2002 |
| CN | 2576039 Y | 10/2003 |

(Continued)

OTHER PUBLICATIONS

International Search Report and Written Opinion corresponding to PCT/US2016/039982, dated Dec. 20, 2016, 11 pages.

*Primary Examiner* — Anne M Kozak
(74) *Attorney, Agent, or Firm* — David Postolski, Esq.; Gearhart Law LLC

(57) ABSTRACT

A collapsible shoe heel is provided. The collapsible shoe heel features a support member having a first end and second end, a substantially u-shaped lifting member having a first end and a second end, an angle, formed by the support member and the lifting member, which has a natural position, a first hinge rotatably connecting the first end of the support member and the first end of the lifting member, and a second hinge rotatably connecting the second end of the support member and the second end of the lifting member. The first hinge and second are configured to retain the natural position of the angle.

8 Claims, 8 Drawing Sheets

(56) References Cited

U.S. PATENT DOCUMENTS

| | | | | |
|---|---|---|---|---|
| 9,820,527 | B2 * | 11/2017 | Pratt | A43B 23/28 |
| 2002/0129519 | A1 | 9/2002 | Cahan | |
| 2005/0050772 | A1 | 3/2005 | Miller et al. | |
| 2011/0146106 | A1 | 6/2011 | Kaufman | |
| 2012/0317839 | A1 | 12/2012 | Pratt | |

FOREIGN PATENT DOCUMENTS

| | | | |
|---|---|---|---|
| CN | 2681583 | Y | 3/2005 |
| CN | 2706027 | Y | 6/2005 |
| CN | 2732011 | Y | 10/2005 |
| CN | 2768518 | Y | 4/2006 |
| CN | 2817519 | Y | 9/2006 |
| CN | 2827052 | Y | 10/2006 |
| CN | 2857556 | Y | 1/2007 |
| CN | 2862772 | Y | 1/2007 |
| CN | 2884952 | Y | 4/2007 |
| CN | 2907303 | Y | 6/2007 |
| CN | 2914723 | Y | 6/2007 |
| CN | 2925168 | Y | 7/2007 |
| CN | 2930361 | Y | 8/2007 |
| CN | 200944874 | Y | 9/2007 |
| CN | 201022379 | Y | 2/2008 |
| CN | 201085313 | Y | 7/2008 |
| CN | 201153552 | Y | 11/2008 |
| CN | 201157013 | Y | 12/2008 |
| CN | 201157015 | Y | 12/2008 |
| CN | 201185682 | Y | 1/2009 |
| CN | 201185690 | Y | 1/2009 |
| CN | 201248397 | Y | 6/2009 |
| CN | 201248409 | Y | 6/2009 |
| CN | 201278857 | Y | 7/2009 |
| CN | 201388590 | Y | 1/2010 |
| CN | 201403581 | Y | 2/2010 |
| CN | 201414481 | Y | 3/2010 |
| CN | 201430935 | Y | 3/2010 |
| CN | 201577620 | U | 9/2010 |
| CN | 201591163 | U | 9/2010 |
| CN | 201612206 | U | 10/2010 |
| CN | 201698102 | U | 1/2011 |
| CN | 201750719 | U | 2/2011 |
| CN | 201775054 | U | 3/2011 |
| CN | 201798093 | U | 4/2011 |
| CN | 201813941 | U | 5/2011 |
| CN | 201839822 | U | 5/2011 |
| CN | 201860884 | U | 6/2011 |
| CN | 201860884 | U | 6/2011 |
| CN | 201878901 | U | 6/2011 |
| CN | 201894193 | U | 7/2011 |
| CN | 201929102 | U | 8/2011 |
| CN | 201948075 | U | 8/2011 |
| CN | 201958304 | U | 9/2011 |
| CN | 202005293 | U | 10/2011 |
| CN | 202005304 | U | 10/2011 |
| CN | 202026813 | U | 11/2011 |
| CN | 202127896 | U | 2/2012 |
| CN | 202160757 | U | 3/2012 |
| CN | 202190809 | U | 4/2012 |
| CN | 202211219 | U | 5/2012 |
| CN | 202311520 | U | 7/2012 |
| CN | 202335400 | U | 7/2012 |
| CN | 202335435 | U | 7/2012 |
| CN | 202364943 | U | 8/2012 |
| CN | 202407344 | U | 9/2012 |
| CN | 202425687 | U | 9/2012 |
| CN | 202489188 | U | 10/2012 |
| CN | 202514680 | U | 11/2012 |
| CN | 202514692 | U | 11/2012 |
| CN | 202525218 | U | 11/2012 |
| CN | 202566567 | U | 12/2012 |
| CN | 202722642 | U | 2/2013 |
| CN | 202722678 | U | 2/2013 |
| CN | 202932142 | U | 5/2013 |
| CN | 203073092 | U | 7/2013 |
| CN | 203182127 | U | 9/2013 |
| CN | 203244003 | U | 10/2013 |
| CN | 203262421 | U | 11/2013 |
| CN | 203290308 | U | 11/2013 |
| CN | 203341088 | U | 12/2013 |
| CN | 203523950 | U | 4/2014 |
| CN | 203523951 | U | 4/2014 |
| CN | 203789246 | U | 8/2014 |
| CN | 203913570 | U | 11/2014 |
| WO | WO2013088113 | A2 | 6/2013 |

* cited by examiner

COLLAPSIBLE SHOE HEEL

CLAIM OF PRIORITY

This application claims priority to U.S. Provisional Patent Application No.: 62/186,148, filed on Jun. 29, 2015, entitled "COLLAPSIBLE SHOE HEEL," the contents of which are hereby fully incorporated by reference.

FIELD OF THE EMBODIMENTS

The field of the present invention and its embodiments relate to a collapsible shoe heel.

BACKGROUND OF THE EMBODIMENTS

Laced shoes provide greater foot support and protection than do unlaced loafers and sandals. Their insertion and removal from the foot requires greater effort. Shortcutting shoe removal without untying the laces is damaging to the back of the shoe, over time breaking down its structural integrity.

The present invention provides internal spring support within the back of laced shoes, the spring biasing the shoe back in a raised configuration. When putting on or taking off the shoe, pushing down on the back of the shoe overcomes the spring force and lowers the shoe back, easing foot insertion or removal. Once the shoe is on the foot or removed, the downward force against the shoe back ceases, the spring recovers, raising the shoe back.

Review of Related Technology:

U.S. Pat. No. 2,198,228 pertains to a rubber heel to provide improved bonds between the top plate and the body of the heel; to provide improved Ventilating systems for the heel; to provide improved attachments of the heel to the shoe; and to provide a novel reinforced heel.

U.S. Pat. No. 3,174,234 pertains to a shoe heel having a movable door or wall which can be opened to expose a compartment in which a collapsed overshoe is stored. In one form of the invention, the overshoe has a sole engaged at one end in the compartment to hold the overshoe on the shoe when in operative position.

U.S. Pat. No. 3,431,658 pertains to foot coverings such as boots, shoes and the like. More particularly, it is concerned with providing boots and shoes with means to assure a tight and snug fit, said means comprising broadly an expandable bellows disposed in the counter area.

U.S. Pat. No. 6,298,583 pertains to a camp shoe that is similar in most aspects to a typical shoe. However, to make it easy to pack and tote in a knapsack, for example, this shoe has construction features that permit it to be folded flat to conform with sole of the shoe and, therefore, be easily tucked in and toted in luggage where spare space is typically at a premium. The construction features include a rigid heel counter; a heel support flexibly attached to said heel counter; a pair of upper ankle supports flexibly attached to said heel support; and a pair of lower ankle supports flexibly attached to said upper ankle supports and said heel counter.

U.S. Pat. No. 7,168,190 pertains to an article of footwear including an upper formed of a flexible upper material and a sole formed of a flexible sole material, wherein the sole is rolled, folded, or collapsed onto itself to reduce the volume of the article of footwear. The article of footwear in a collapsed state can then be packaged in a container. This container can be dispensed by a vending machine in a convenient urban area.

U.S. Pat. No. 7,578,075 pertains to a shoe having a removable heel, removable platform, and in some embodiments one or more removable straps. The removable shoe provides for flexibility in design with the same sole by allowing for replacement of one type of heel with another and in some shoes replacement of the strap or straps by alternate styles or colors of straps. The replaceability or modularity of the heel and straps allows for compact storage as well, which is desirable during travel. The removeability of the platform enables the shoe to adjust to different heights. Additionally, some embodiments have one or more hinges formed in the sole to allow the shoe to collapse to an even smaller size for storage or travel.

U.S. Pat. No. 8,020,320 pertains to an article of footwear including an upper formed of a flexible upper material and a sole formed of a flexible sole material, wherein the sole is rolled, folded, or collapsed onto itself to reduce the volume of the article of footwear. The article of footwear in a collapsed state can then be packaged in a container. This container can be dispensed by a vending machine in a convenient urban area.

United States Patent Publication No.: 2002/0129519 pertains to a shoe that includes a sole and a collapsible upper attached to the sole. The upper includes a vamp portion to be worn around the toes and forepart of a foot of a wearer, a heel portion to be worn adjacent the heel of the wearer, side portions provided between the vamp portion and the heel portion to be worn adjacent the sides of the foot of the wearer, and insets, at least one inset being provided between each side portion and the heel portion of the upper. The insets are made of a thin, flexible material which can be easily folded to allow the vamp portion, side portions and heel portion of the upper to collapse onto the sole when not being worn.

United States Patent Publication No.: 2005/0050772 pertains to an improved expandable shoe and inner assembly are disclosed. The expandable shoe includes an outer shell and an adjustable inner assembly is disposed within the outer shell. The inner assembly has a first board portion and a second board portion in overlapping engagement with each other and a control to adjust the position of the first board portion relative to the second board portion. A lighted visualization window provides a visualization window to the inner assembly. The inner assembly may include size markings through the visualization window so that a size of the adjusted shoe may be determined as shoe size is adjusted.

Chinese Patent Document No.: CN201860884U pertains to a pair of heel-adjustable shoes which comprise shoe surfaces and heals of the heel-adjustable shoes, wherein the lower end in each heel is connected with a foldable heel by a folding, the upper surface of the foldable heel at the upper end of the folding is provided with a plurality of mother buttons, the upper surface of the foldable heel at the lower end of the folding is provided with a plurality of son buttons, and the mother buttons and the son buttons are arranged with one another oppositely. The heel-adjustable shoes have the characteristics of being compact and ingenious in structure, practical in function and the like, thereby being capable of optionally adjusting the heights of the heels as required, and leading a user to be comfortable to wear the high-heeled shoes.

Chinese Patent Document No.: CN02514680U pertains to a pair of foldable high-heeled shoes, which comprises shoe bodies and is characterized in that the back part of each shoe body is provided with a connecting block; the front part of each connecting block is hinged with a heel through a revolving shaft; a fixing device is arranged between each heel and the corresponding connecting block; and magnets which are matched with each other are arranged on the middle part of each sole and the front part of the corresponding heel respectively. The foldable high-heeled shoes are simple in structure, are convenient for using, are foldable, can be taken as a pair of high-heeled shoes as well as a pair of flat-heeled shoes, and are suitable for various occasions.

Chinese Patent Document No.: CN2862772Y pertains to a foldaway high and flat-heeled dual-purpose shoe. In detail, it is characterized in that: two foldaway heels are divided into the front and back end of heel. Back end and back-end joint is linked by locating hinge on the edge of back end. Moreover, demands for flat-heeled shoe on some occasions by folding back-end of heel based on above structure can be met, thus fulfilling the aims of utility model.

Various systems and methodologies are known in the art. However, their structure and means of operation are substantially different from the present disclosure. The other inventions fail to solve all the problems taught by the present disclosure. At least one embodiment of this invention is presented in the drawings below and will be described in more detail herein.

SUMMARY OF THE EMBODIMENTS

The present invention discloses a collapsible shoe heel, comprising: a support member having a first end and second end; a lifting member having a first end and a second end; an angle, having a natural position, wherein the angle is formed by the support member and the lifting member; a first hinge rotatably connecting the first end of the support member and the first end of the lifting member; a second hinge rotatably connecting the second end of the support member and the second end of the lifting member, wherein the first hinge and second hinge are configured to retain the natural position of the angle. In one preferred embodiment the first hinge and the second hinge are substantially rigid u-shaped segments. In other embodiments the first hinge and second hinge are torsional springs or hinge springs. In another embodiment, the support member and the lifting members are rounded, while in others they have a perimeter with at least four sides. Preferably, the first hinge and the second hinge are coated in rubber, but other embodiments exist where the support member is partially covered in rubber and where the lifting member is partially covered in rubber, either separately or in combination. In other preferred embodiments, the first hinge and the second hinge are configured such that the support member is offset from the lifting member. Preferably, the collapsible shoe heel is integrated into a shoe, and the preferred angle is 30 degrees. In many embodiments, the support member, the lifting member, the first hinge, and the second hinge, are all constructed out of a single continuous material. In another embodiment the support member, the lifting member, the first hinge, and the second hinge, are constructed out of a plurality of wave springs.

The present invention also provides for a method of putting on a shoe, comprising the steps of: providing, a shoe equipped with a collapsible shoe heel, the collapsible shoe heel comprising: a support member having a first end and second end; a lifting member having a first end and a second end; an angle, having a natural position, wherein the angle is formed by the support member and the lifting member; a first hinge rotatably connecting the first end of the support member and the first end of the lifting member; a second hinge rotatably connecting the second end of the support member and the second end of the lifting member, wherein the first hinge and second hinge are configured to retain the natural position of the angle; exerting a downward force on the support member; compressing the collapsible shoe heel such that the angle is less than 10 degrees; sliding a user's foot into the shoe; allowing the collapsible shoe heel to return to the natural position. Preferably, this shoe has laces.

Further, the present invention also provides for a collapsible shoe heel, comprising: a lifting member, wherein the lifting member is substantially u-shaped; an integration member, rotatably attached to the lifting member; a slider, comprising: a top, a bottom, an opening situated between the top and bottom, wherein the opening is sized to receive the integration member, and a plurality of notches, wherein the plurality of notches are configured to receive the second end of the bar; a base, having a sliding chamber and a receiving hole, wherein the sliding chamber is configured to slidably engage with slider, and wherein the base configured to receive a portion of the lifting member; a bar having a first end and second end, wherein the first end is pivotally attached to the receiving hole; a first spring, partially enveloping the integration member, wherein the first spring abuts the slider within the sliding chamber; a second spring, wherein the second spring provides stability for the bar. Preferably, the base is integrated into the sole of a shoe. In many embodiments, this shoe is a sandal.

In general, the present invention succeeds in conferring the following, and others not mentioned, benefits and objectives.

It is an object of the present invention to provide a means for easily putting on shoes.

It is an object of the present invention to discretely provide a way to collapse the heel and rear portion of a shoe.

It is an object of the present invention to increase the functionality of shoes.

DESCRIPTION OF THE PREFERRED EMBODIMENTS

Figure 1:
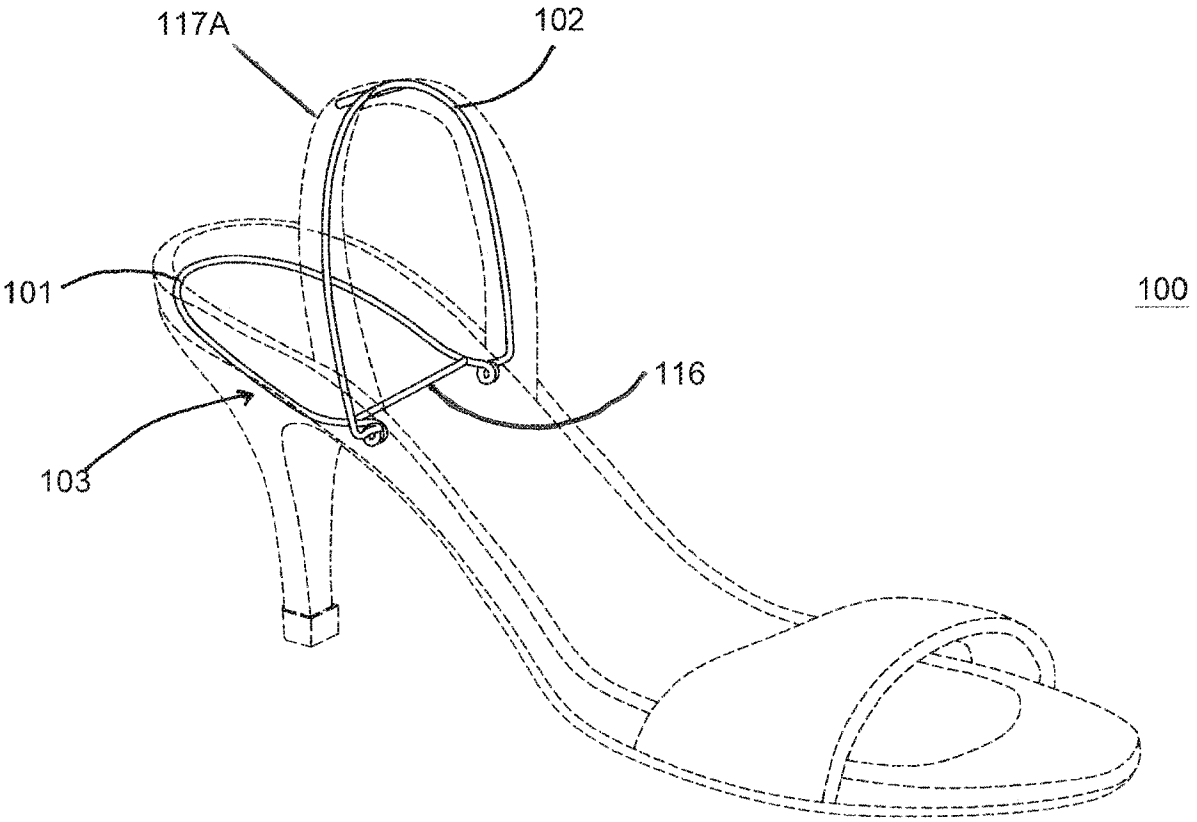
FIG. 1 is a perspective view of an embodiment of the present invention when integrated with a women's dress shoe.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring to FIG. 1, an embodiment of the present invention is shown. Here, collapsible shoe heel 100 features support member 101, lifting member 102, and angle 103. The support member 101 has a first end disposed opposite a second end. The first end of the support member 101 has a rounded curve. The lifting member 102 has a first end disposed opposite a second end. The first end of the lifting member 102 has a rounded curve and comprises a protrusion section 117A (of FIGS. 1) and 117B (of FIG. 3). The second end of the support member 101 comprises a support structure 116. Here, collapsible shoe heel 100 is shown in the natural position. Upon application of a compressive load at the top of the lifting member, the lifting member arm rotates in a downward direction as the load is applied, with the support member support member biased against the bottom insole surface of the show, and essentially does not move. Preferably, the present invention operates by a person's hand squeezing against and compressing a shoe back which contains the lifting member. According to an embodiment, the support member 101 further includes a support structure 116 extending across the support member 101 and configured to provide additional support to the support member 101. According to an embodiment, the lifting member 102 further includes a protrusion section 117B (further shown in FIG. 3) that protrudes from the lifting member 102, wherein the protrusion section 117B is configured to provide further support to a portion of a shoe being lifted by the lifting member 102.

Figure 2:
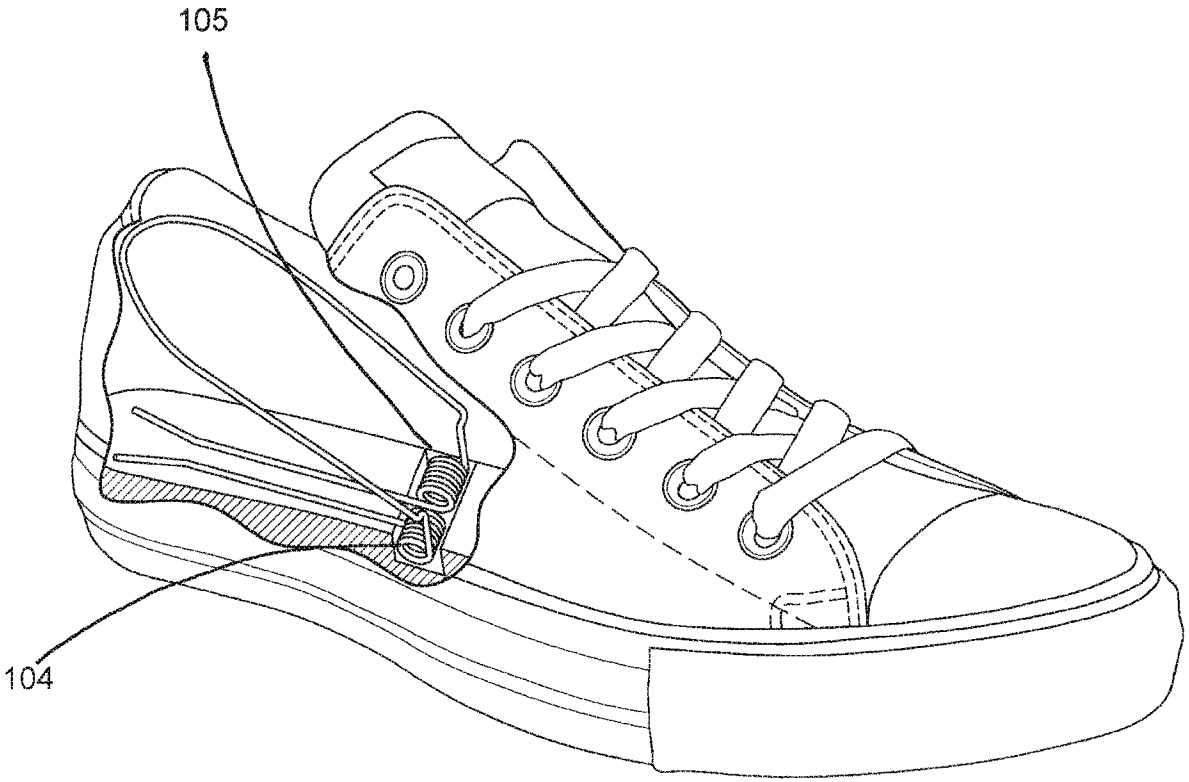
FIG. 2 is a perspective view of an alternative embodiment of the present invention when integrated with a casual shoe.

Referring to FIG. 2, another embodiment of the present invention is shown. Of note here are first hinge 104 and second hinge 105. Here, first hinge 104 and second hinge 105 are located within the shoe to enable such recoverable shoe back compression, and are torsion springs. The first hinge 104 rotatably connects the second end of the support member 101 and the second end of the lifting member 102. The second hinge 105 rotatably connects the second end of the support member 101 and the second end of the lifting member 102. Each of the first hinge 104 and the second hinge 105 are configured to define the angle 103 (of FIG. 1) between the second end of the support member 101 and the second end of the lifting member 102 when the lifting member 102 is in an expanded position without an application of force. Such expanded position is a non-compressed position. As explained previously, the preferred angle (e.g., the angle 103 of FIG. 1) is 30 degrees. As the collapsible shoe heel 100 is collapsed or compressed, the angle 103 moves towards a 0 degree angle. The support member 101 extends along the insole of the shoe towards the heel. The lifting member 102 angles up from the torsion spring to a location at the top of the shoe back. The downward rotation of the lifting member 102 compresses the torsion spring. Removal of the compressive load from the lifting member 102 initiates torsion spring recovery. The lifting member 102 upwardly rotates to its original position, fully extending the shoe back. In this regard, use of an exceedingly flexible material to fabricate the shoe back enables multiple compression and recovery cycles without experiencing cracking or other modes of material failure.

Figure 3:
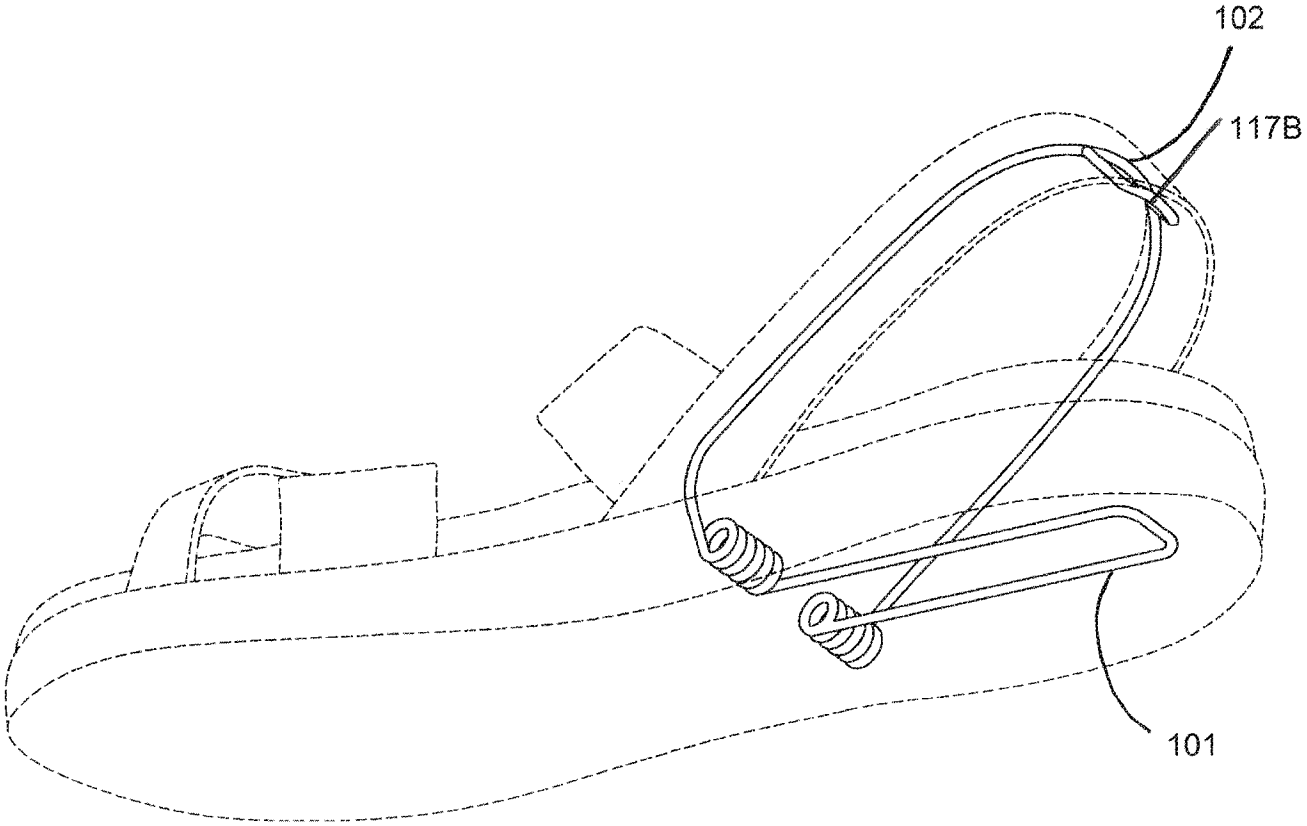
FIG. 3 is a bottom perspective view of yet another alternative embodiment of the present invention when integrated with a shoe.

Referring to FIG. 3, an alternative embodiment of the present invention is shown. Here, the present invention features support member 101 and lifting member 102. As can be seen, support member 101 can have a variety of configurations, such as the configuration shown here. By varying the shape of the support member, one can vary the size and shape of the support member, permitting size adjustment to fit shoes of different sizes and styles.

Figure 4:
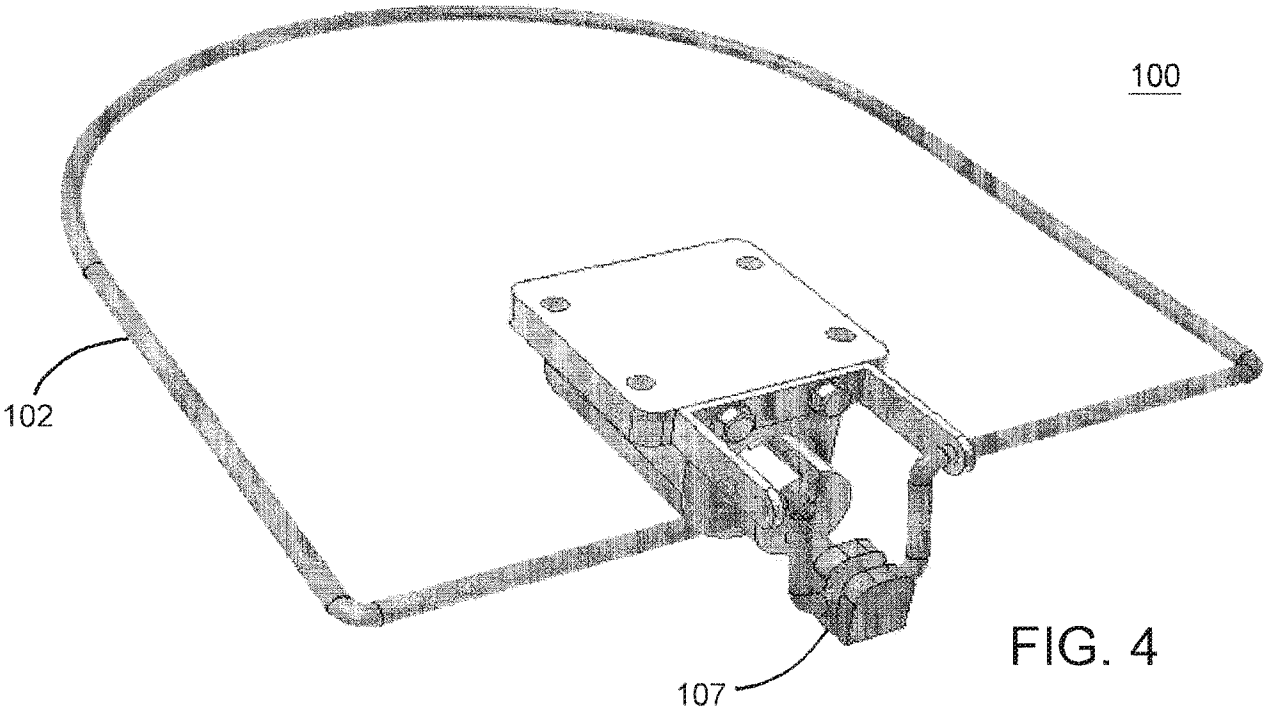
FIG. 4 is a perspective view of a rendering of a preferred embodiment of the present invention.

Referring to FIG. 4, another alternative embodiment of the present invention is shown. Here, collapsible shoe heel 100 features lifting member 102, and integration member 107. In this embodiment, the present invention has two positions: an "up" position and a "down" position. This embodiment will retain whichever position it is in until some force is exerted on lifting member 102. When this happens, similar to the clicking of a ballpoint pen, collapsible shoe heel 100 will shift to the second position.

Figure 5:
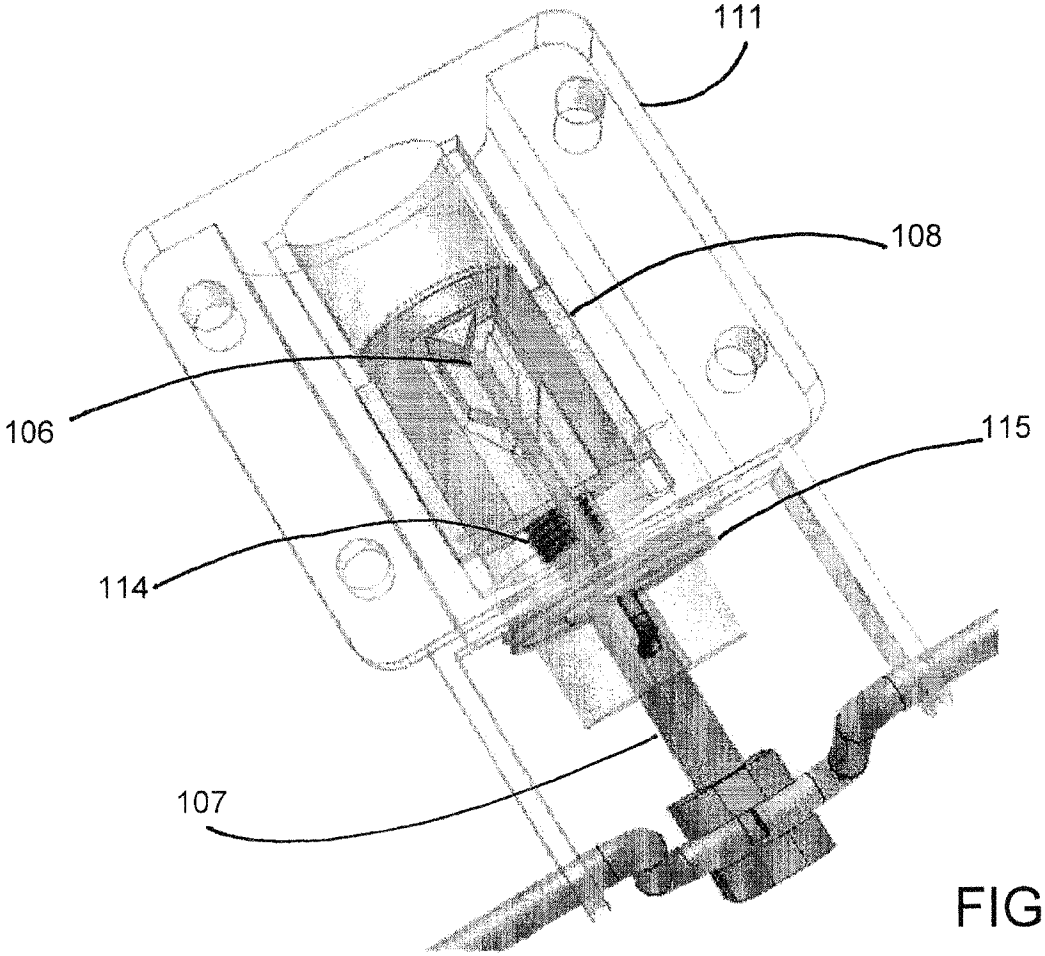
FIG. 5 is a callout view of the embodiment shown in FIG. 4.
Figure 6B:
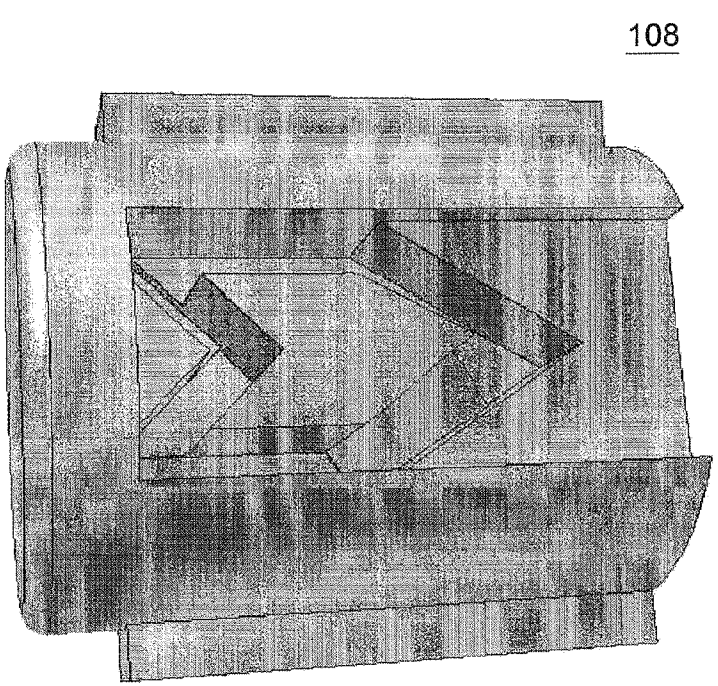
FIGS. 6A and 6B show two perspective view of an embodiment of the slider of the present invention.
Figure 6A:
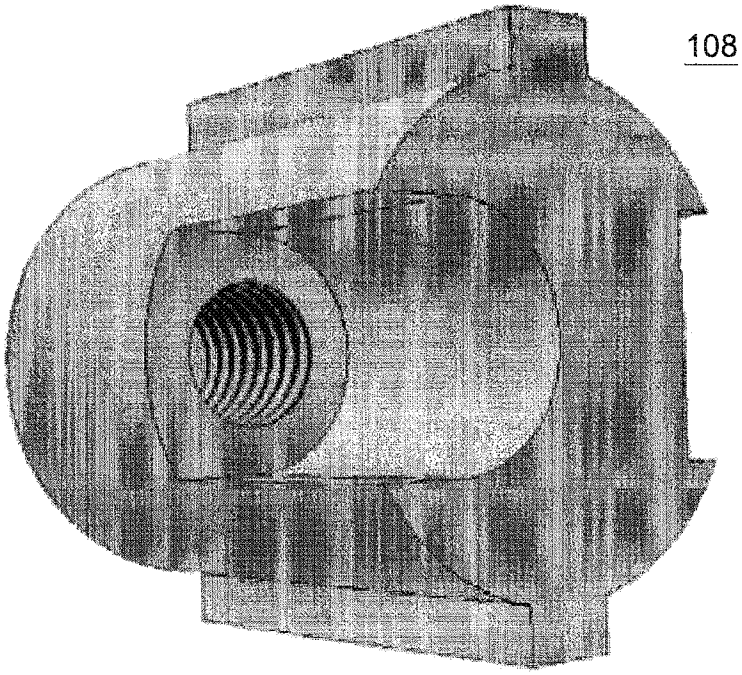
Figure 7B:
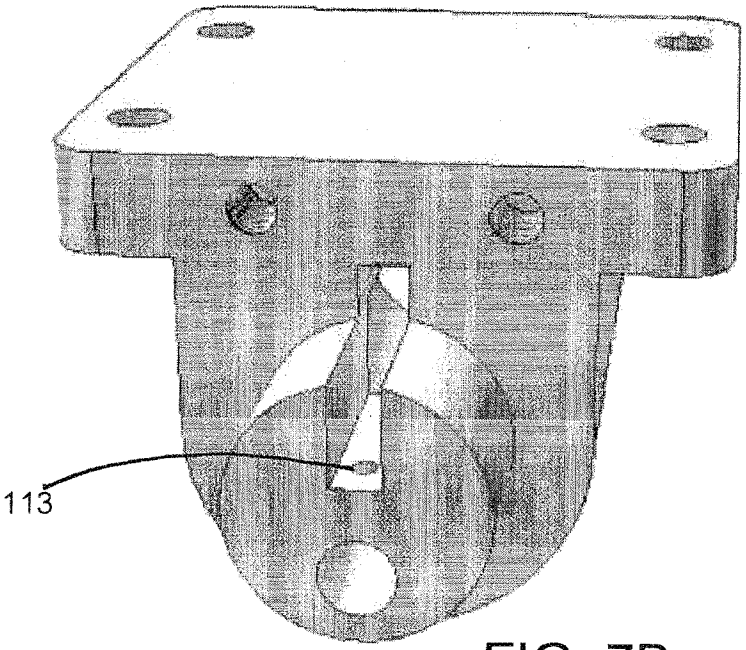
FIGS. 7A and 7B show two perspective view of an embodiment of the base of the present invention.
Figure 7A:
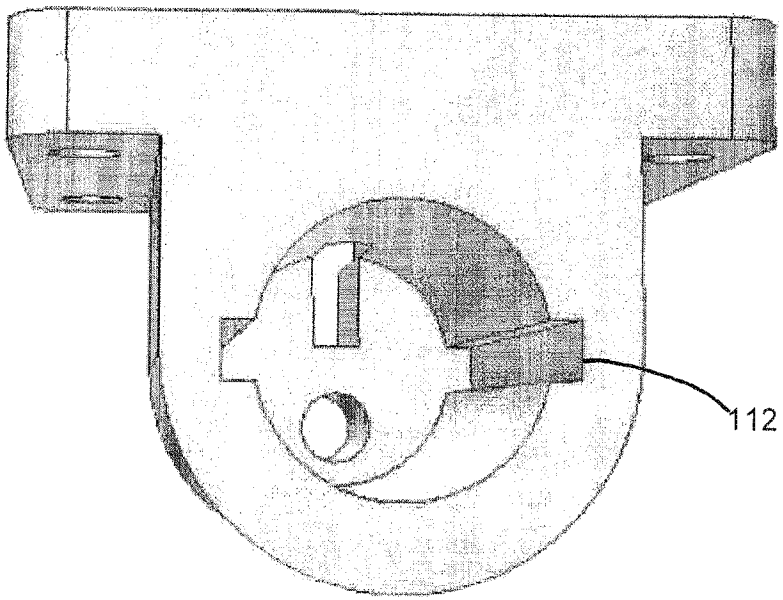
Figure 9:
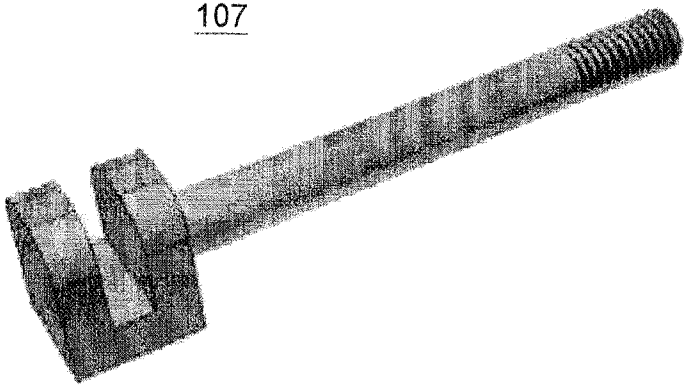
FIG. 9 is a perspective view of an embodiment of the integration member of the present invention.
Figure 8:
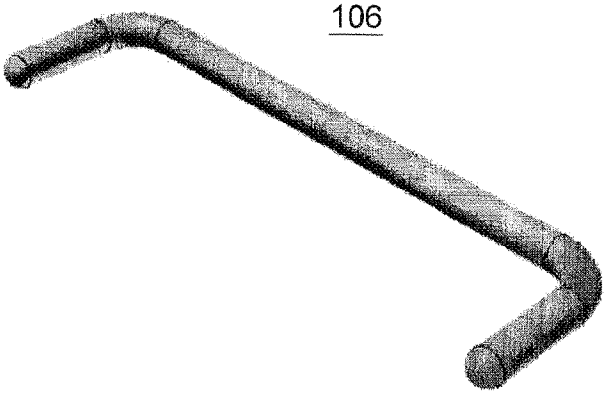
FIG. 8 is a perspective view of an embodiment of the bar of the present invention.

Referring to FIG. 5, the present invention features bar 106, slider 108, integration member 107, base 111, first spring 114, and second spring 115. This view shows how this particular embodiment functions. Specifically, upon force being applied to lifting member 102, lifting member 102 will actuate integration member 107. From there, integration member 107 will push slider 108 such that bar 106 travels along the notches of slider 108. These notches are configured so that the end of bar 106 that interfaces with the slider 108 will move counterclockwise along the notches. The first spring 114 forces slider 108 towards the integrated end of bar 106. When a user wants to toggle the position of the present invention, they merely need to exert force on lifting member 102 to start this process.

FIGS. 6A-9 show detailed views of slider 108, base 111, bar 106, and integration member 107, respectively. Regarding FIGS. 7A and 7B, base 111 features sliding chamber 112, and integration hole 113.

In a preferred embodiment, shows a shoe having a different type of spring installed between the outer and inner shoe layers. A pair of metal extensions (such as steel) are connected to the lifting member. In a similar manner as discussed above, application of a compressive load on the lifting member results in a bending of the lifting member, enabling the lifting member to lower towards the support member. Removal of the compressive load enables recovery of the lifting member, and the raising of the lifting member to the natural position.

In another preferred embodiment, the lifting member may be fabricated out of such materials as zinc-plated steel, stainless steel or such composite materials as Nylon® 6/6 Glass reinforced or ABS Glass reinforced. Utilization of the lifting member focuses flex and recovery characteristics on the material used to fabricate the lifting member, and not the steel extensions, which would permanently deform. Substitution of differently sized lifting members and support members enables the easy adaption to shoes of different size or style. The extension spring design offers long-term operational and structural stability.

In some embodiments, the present invention is constructed with a ribbon spring. The spring preferably consists of a solid flat member configured into a double-loop. The lower or base loop would extend along the insole in the heel area of the shoe, the upper loop extending toward the top of the shoe back. Two substantially u-shaped segments connects the two loops, serving as the first hinge and second hinge of the present invention. Spring steel or a composite (Nylon® 6/6 or ABS Glass reinforced) are materials suitable for fabricating the ribbon spring.

In other embodiments, the present invention is constructed with a tube-spring that utilizes a tubular member configured into a double-loop. The lower or base loop extending along the back of the shoe insole, and the upper loop extending toward the top of the shoe back. Two substantially u-shaped segments connects the two loops, serving as the first hinge and second hinge of the present invention. Composite materials such as Nylon® 6/6 or ABS Glass reinforced are suitable for fabrication of the tube spring.

In still other embodiments, the present invention consists of two U-shaped members of spring steel or a composite material that are connected by extendable loop sections, serving as the support member and the lifting member.

In other exemplary embodiments, the present invention is integrated into a moccasin, sneaker, dress shoe, high heel, or a sandal. Further, the present invention can accommodate all sizes of shoes by varying the size of the present invention. The present invention is suitable for use in children's shoes as well as adult shoes.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Therefore, it is intended that the disclosure not be limited to the particular embodiments disclosed.

What is claimed is:

1. A shoe comprising: a collapsible shoe heel integrated into the shoe, the collapsible shoe heel comprising: a support member having a first end that is rounded and second end, the support member further includes a support structure providing support to the second end of the support member and extending across the second end of the support member, wherein the support member and the support structure are located within a sole of the shoe; a lifting member having a first end and a second end, wherein the first end of the lifting member has a rounded curve and comprises a protrusion section, wherein the protrusion section protrudes from the first end of the lifting member and is configured to provide support to a portion of a shoe being lifted by the lifting member, and wherein the second end of the lifting member; a 30 degree angle formed between the second end of the support member and the second end of the lifting member when the lifting member is in an expanded position without an application of a compressive load; a first hinge rotatably connecting a portion of the second end of the support member and a portion of the second end of the lifting member; and a second hinge rotatably connecting another portion of the second end of the support member and another portion of the second end of the lifting member, wherein each of the first hinge and second hinge are configured to define the 30 degree angle when the lifting member is in the expanded position without the application of the compressive load, and wherein the first hinge and the second hinge are located within the sole of the shoe.

2. The collapsible shoe heel of claim 1, wherein the first hinge and second hinge are torsional springs.

3. The collapsible shoe heel of claim 1, wherein the first hinge and second hinge are torsional springs.

4. The collapsible shoe heel of claim 1, wherein the first hinge and the second hinge are coated in rubber.

5. The collapsible shoe heel of claim 1, wherein support member is partially covered in rubber.

6. The collapsible shoe heel of claim 1, wherein lifting member is partially covered in rubber.

7. The collapsible shoe heel of claim 1, wherein the first hinge and the second hinge are configured such that the support member is offset from the lifting member.

8. The collapsible shoe heel of claim 1, wherein the support member, the lifting member, the first hinge, and the second hinge, are all constructed out of a single continuous material.

* * * * *